US006349970B2

(12) United States Patent
Fero

(10) Patent No.: US 6,349,970 B2
(45) Date of Patent: Feb. 26, 2002

(54) PRINTED PUBLICATION HAVING INTEGRATED BOOKMARKS AND METHOD OF MANUFACTURING SAME

(75) Inventor: Brian A. Fero, Evanston, IL (US)

(73) Assignee: R. R, Donnelley & Sons Company, Chicago, IL (US)

( * ) Notice: Subject to any disclaimer, the term of this patent is extended or adjusted under 35 U.S.C. 154(b) by 0 days.

(21) Appl. No.: 09/804,882

(22) Filed: Mar. 13, 2001

Related U.S. Application Data

(62) Division of application No. 09/484,145, filed on Jan. 18, 2000.

(51) Int. Cl.[7] ..... B42D 9/00

(52) U.S. Cl. ..... 281/42; 40/299.01; 283/36; 283/38; D19/34

(58) Field of Search ..... 281/42; 283/36–43, 283/101, 105, 103; D19/34; 40/299.01

(56) References Cited

U.S. PATENT DOCUMENTS 3,290,059 A * 12/1966 Newman
3,312,005 A * 4/1967 McElroy
3,582,111 A * 6/1971 Siiter
3,583,358 A * 6/1971 Hanson, Jr. ..... 116/119
3,922,464 A * 11/1975 Silver et al.
3,937,493 A * 2/1976 Fasbender ..... 283/41
3,958,816 A * 5/1976 Remmey, III (List continued on next page.)

*Primary Examiner*—A. L. Wellington
*Assistant Examiner*—Monica Carter
(74) *Attorney, Agent, or Firm*—Marshall, Gerstein & Borun

(57) ABSTRACT

A printed publication having integrated labels or bookmarks, as well as a method for manufacturing same are disclosed. The printed publication includes a plurality of pages and a cover, at least one of which includes a plurality of bookmarks releasably adhered thereto. The bookmarks can be individually removed by the user, and repositioned elsewhere within the publication for marking and later reference purposes. The method includes the steps of applying an adhesive coating along a moving web of material, applying a release coating to the moving web, folding the web such that the adhesive coating is adhered to the release coating, and cutting the web into individual labels.

28 Claims, 4 Drawing Sheets

U.S. PATENT DOCUMENTS 4,168,196 A * 9/1979 Nemeth et al. ..... 156/184
4,235,459 A * 11/1980 Callahan
4,329,191 A * 5/1982 Barber
4,394,904 A * 7/1983 Larimore ..... 206/447
4,580,815 A * 4/1986 Barber
4,614,361 A * 9/1986 Foster
4,614,364 A * 9/1986 Bortner ..... 283/45
4,636,432 A * 1/1987 Shibano et al.
4,643,455 A * 2/1987 North et al.
4,680,210 A * 7/1987 Corcoran ..... 428/42
4,752,087 A * 6/1988 Weisbach
4,895,747 A * 1/1990 Birkholz et al.
5,011,189 A * 4/1991 Olson ..... 283/81
5,084,354 A * 1/1992 Krankkala et al. ..... 428/414
5,101,756 A * 4/1992 Strumbos ..... 116/234
5,104,148 A * 4/1992 Neal ..... 283/81
5,182,152 A * 1/1993 Ericson ..... 428/42
5,249,546 A * 10/1993 Pennelle ..... 116/234
5,332,265 A * 7/1994 Groess et al. ..... 283/56
5,359,793 A * 11/1994 Copperstone ..... 40/124.1
5,462,783 A * 10/1995 Esselmann ..... 428/40
5,507,901 A * 4/1996 Limina et al. ..... 156/200
5,518,762 A * 5/1996 Soltysiak et al.
5,641,182 A * 6/1997 Schwandt ..... 283/36
5,641,567 A * 6/1997 Brown et al.
5,702,127 A * 12/1997 Korondi, Jr. ..... 283/81
5,833,793 A * 11/1998 Zarembo et al.
5,911,442 A * 6/1999 Olson ..... 283/36
5,972,155 A * 10/1999 Cooprider et al.
5,985,775 A * 11/1999 Deeb et al.
5,989,383 A * 11/1999 Zarembo et al.
5,989,708 A * 11/1999 Kreckel
5,990,238 A * 11/1999 DiZio et al.
6,001,471 A * 12/1999 Bries et al.
6,004,642 A * 12/1999 Langford
6,013,154 A * 1/2000 Abe
6,013,409 A * 1/2000 Chou
6,022,914 A * 2/2000 Nowak et al.
6,042,882 A * 3/2000 Deeb et al.
6,042,895 A * 4/2000 Hyde et al.
6,048,806 A * 4/2000 Deeb et al.
6,056,492 A * 5/2000 Hudson ..... 412/1
6,063,225 A * 5/2000 Riordan
6,063,838 A * 5/2000 Patnode et al.
6,095,565 A * 8/2000 Kramer ..... 281/42
6,257,623 B1 * 7/2001 Fero ..... 281/42

* cited by examiner

PRINTED PUBLICATION HAVING INTEGRATED BOOKMARKS AND METHOD OF MANUFACTURING SAME

This is a Divisional of U.S. application Ser. No. 09/484,145, filed Jan. 18, 2000.

FIELD OF THE INVENTION

The present invention generally relates to printed publications, and more particularly relates to printed publications with integrated reference labels or bookmarks.

BACKGROUND OF THE INVENTION

In many professions, as well as recreational endeavors, information is provided in the form of periodical printed publications. Such publications may be provided in the form of journals providing scholarly guidance, catalogs providing detailed information regarding merchandise available for purchase, magazines providing sundry information, etc. The rate at which these publications are produced can be as frequent as, for example, daily, weekly, or monthly, and can thus result in a substantial time commitment in terms of review, as well as a substantial space requirement in terms of storage.

Many techniques and methods have therefore been developed for marking individual pages or sections of such publications for later reference. Some of these methods and techniques include the process of "dog-earing" the corner of a particular page of interest, or underlining, highlighting, or annotating sections of the publication. These methods can refresh the memory of the reviewer if later found, but detrimentally affect the appearance and condition of the printed publication. Alternatively, a self-adhesive label, such as a POST-IT® brand label, available from 3M Corporation, St. Paul, Minn., can be adhered to a relevant page with personalized notes or the like.

Another reference-aid apparatus and method is disclosed in the U.S. Pat. No. 5,011,189, which provides a publication reference aid system in the form of detachable labels. More specifically, individual labels are initially attached to an inside page or the outside surface of a printed publication and are removable along a scored line between the label and a tongue portion permanently glued to the publication. The label can therefore be torn from the publication along the scored line and, through the use of a releasable adhesive strip provided on the label, be adhered to a relevant page within the publication. Before doing so, a separate covering page or strip must be removed to expose the adhesive. Such a device therefore produces unwanted and wasteful material in the form of the covering strip, and also requires a relatively complicated method for manufacturing in that, among other things, the label and tongue portion must be separately produced and glued to the publication.

U.S. Pat. No. 5,507,901 discloses a method of manufacturing integrated labels wherein a sheet of paper is provided with linear sections of release coating and pressure sensitive adhesive divided by a line of demarcation. The pressure sensitive adhesive area is folded over onto the release coating along the line of demarcation and later cut into individual labels or sheets. The patent is directed to integrated sheets of labels, and is not for use in conjunction with printed publications, nor are the labels integrated into a printed publication.

SUMMARY OF THE INVENTION

In accordance with one aspect of the present invention, a printed publication having a plurality of bookmarks integrated into the publication is provided. The printed publication includes a plurality of pages bound together at a common binding, and a plurality of bookmarks adhered to at least one of the pages. Each bookmark is removable and directly repositionable within the printed publication.

In accordance with other aspects of the invention, at least one page of the publication includes a strip of release coating, and the plurality of bookmarks include a strip of adhesive which adheres the bookmarks to the release coating and to the page. The strip of adhesive may be wider than the strip of release coating. The bookmarks may be provided in alternating directions to facilitate application of the bookmarks to opposed pages of the publication.

In accordance with another aspect of the invention, a method of manufacturing a printed publication with integrated releasable bookmarks is provided which includes the steps of printing characters onto a moving web of material, applying a release coating to a portion of the moving web, applying an adhesive coating to the moving web, folding the moving web between the release coating and the adhesive coating to form a first layer atop a second layer, cutting the first layer into individual bookmarks, cutting the moving web into individual pages, and binding the individual pages together. The web moves along a longitudinal axis and the release coating and adhesive coating are applied in the direction of the longitudinal axis.

In accordance with another aspect of the invention, a printed publication having releasable bookmarks integrated into the publication is provided which includes a plurality of pages bound together, with each page having an outer edge, a release coating applied to at least one edge, and a plurality of bookmarks adhered to the at least one edge. Each bookmark includes an adhesive coating applied to a portion thereof with the adhesive coating releasably adhering the plurality of bookmarks to the edge. The plurality of bookmarks are formed by folding the at least one edge and cutting the edge into individual bookmarks.

In accordance with yet another aspect of the invention, a method of manufacturing printed material having a plurality of bookmarks adhered thereto is provided. The method includes the steps of providing a moving web of printed material, applying a strip of release coating along a longitudinal axis of the printed material, applying a strip of adhesive coating substantially parallel to the strip of release coating, folding the moving web between the strip of release coating and the strip of adhesive coating such that the adhesive coating adheres a first layer of the moving web to a second layer of the moving web, the adhesive being adhered to the release coating and the printed material, and cutting the first layer into individual bookmarks.

These and other aspects and features of the present invention will become more apparent from the following detailed description when taken in conjunction with the accompanying drawings.

Figure 1:
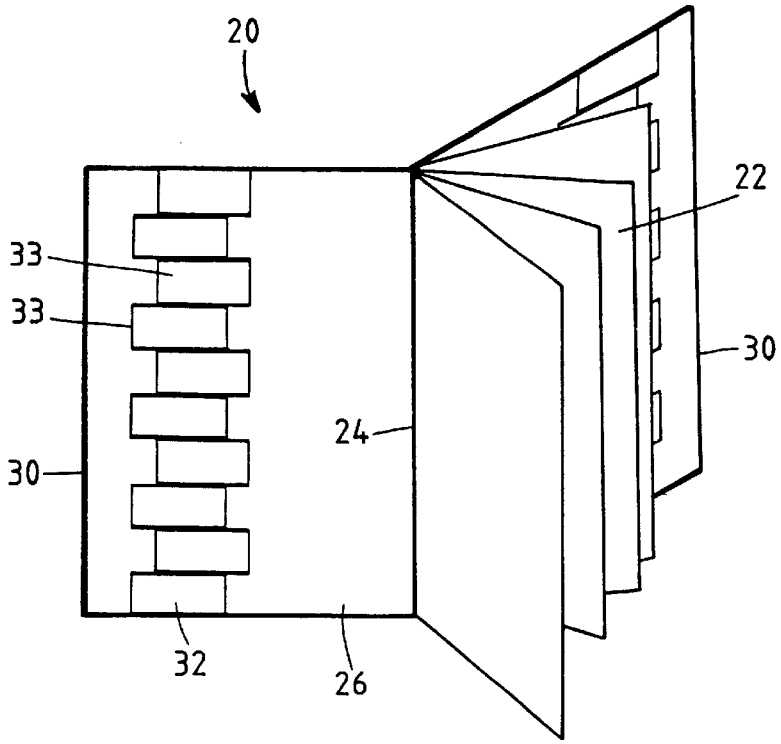
FIG. 1 is an isometric view of a printed publication in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a printed publication according to the present invention is generally depicted by reference numeral 20. As shown therein, the printed publication 20 includes a plurality of pages 22 joined together at a binding 24 and held within an outside cover 26. The printed publication 20 can be any type of publication including catalogs, advertisements, magazines, journals, books, and the like. The binding 24 may be provided in many forms including, but not limited to, adhesive backings, staples, and stitches. In addition, the cover 26 need not be of a separate material than the pages 22, but can be manufactured from the same paper or material used to manufacture the pages 22.

Proximate an outside edge 30 of at least one of the pages 22 (which, as used herein, shall be understood to include the cover 26), a number of removable bookmarks 32 are provided. The bookmarks 32 are temporarily adhered to the page 22 and can be easily removed by a reader by pulling on a tab 33 formed at one end of each bookmark 32. The removed bookmark 32 may then be repositioned anywhere within the printed publication 20 for identification and later reference purposes. Accordingly, it is preferred that a strip of release coating 34 (FIG. 3) and a strip of pressure sensitive adhesive coating 36 (FIG. 3) be employed as will be described in further detail herein. The bookmarks 32 may be provided with suitable markings and information to, among other things, guide the user upon later reference, or to foster recognition of trademarks displayed thereon.

Each bookmark 32 is preferably adhered by the strip of adhesive coating 36 not only to the strip of release coating 34, but to a tackstrip portion 37 of the page 22 as well. In so doing each bookmark 32 is securely adhered to the page 22 and is less susceptible to being inadvertently removed during subsequent manufacturing and handling operations. Moreover, by securing each bookmark 32 to the page 22, adjacent bookmarks are less susceptible to being inadvertently removed along with the bookmark of interest in the event that the adjacent bookmarks are not completely severed apart.

Figure 2:
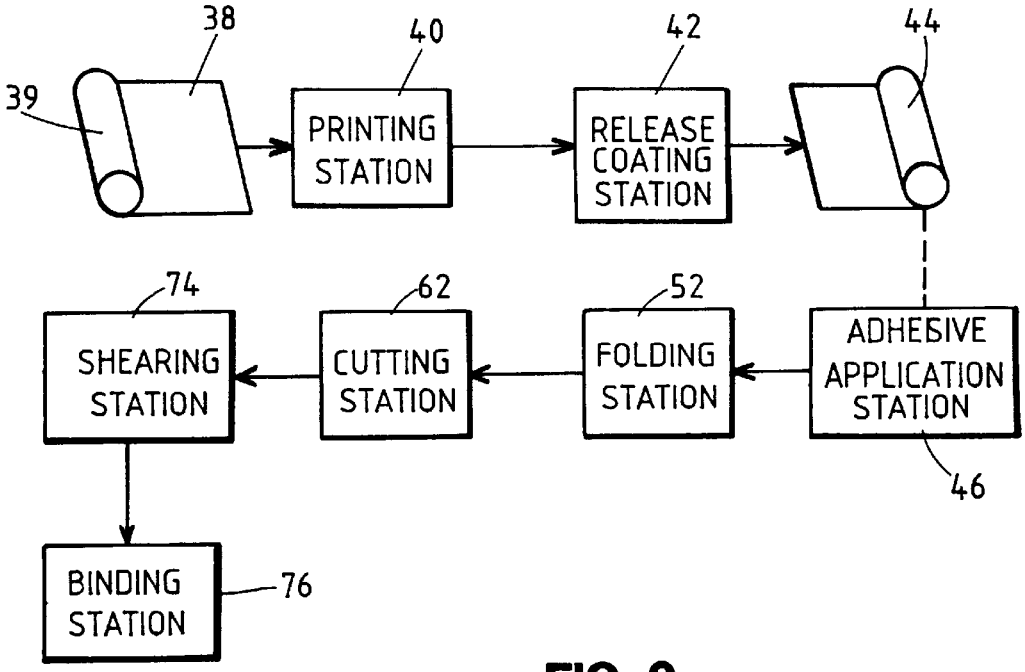
FIG. 2 is a schematic representation of a method of manufacturing according to the present invention.

Referring now to FIG. 2, a method by which the printed publication 20 can be manufactured is schematically depicted. As shown therein, a moving web 38 of material, typically paper, is provided for linear movement through a number of operational stations described in further detail herein. The material forming the web 38 typically is provided in the form of a wound roll 39 received from a paper mill or the like, and mounted for unwinding and subsequent operations.

At a printing station 40, the web 38 is imprinted with the information and artwork desired for the printed publication 20, in an orientation suitable for later folding and assembly. It is to be understood that the printing station 40 may employ any printing method including, for example, moving type, ink-jet printing, laser printing, etc.

Downstream of the printing station 40, a release coating application station 42 is provided to apply the strip of release coating 34 of release material to the moving web 38. The strip of release coating 34 may be any low coefficient of friction material such as silicone, varnish, etc. The strip of release coating 34 is applied to the moving web 38 in a linear strip substantially parallel to a longitudinal axis A (FIG. 4) of the moving web 38. The strip of release coating 34 is then dried or otherwise cured, such as through exposure to ultraviolet light, and preferably wound into another roll 44.

Figure 3:
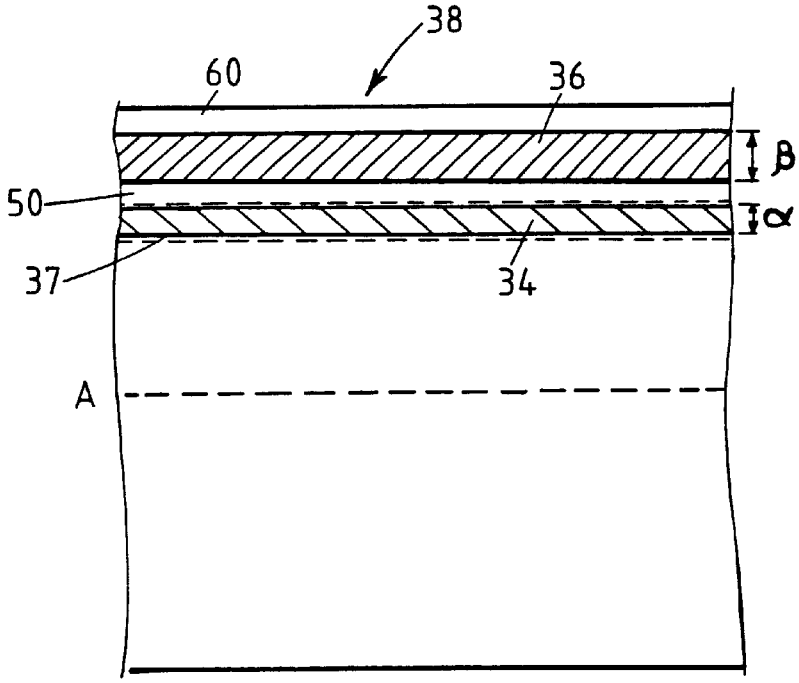
FIG. 3 is a top plan view of a web of material having a release coating and adhesive coating applied thereto prior to folding.

The roll 44 is then directed to an adhesive application station 46. Alternatively, the web 38 can continue directly from the release coating station 42 to the adhesive application station 46 without being intermediately wound into the roll 44. At the adhesive application station 46, the strip of adhesive coating 36 is applied to the moving web 38. The strip of adhesive coating 36 is substantially parallel to the strip of release coating 34, and in the preferred embodiment is spaced laterally therefrom by a folding zone 50 (FIG. 3). In the preferred embodiment, the strip of release coating 34 is provided at a width $\alpha$ and the adhesive coating 48 is provided at a width $\beta$. The width $\beta$ of the adhesive coating 36 is preferably greater than the width $\alpha$ of the release coating 34 to provide for adhesion of the adhesive 36 to the tackstrip 37. Alternatively, the tackstrip 37 can also be formed by appropriately offsetting the release coating 34 and the adhesive coating 36.

Figure 4:
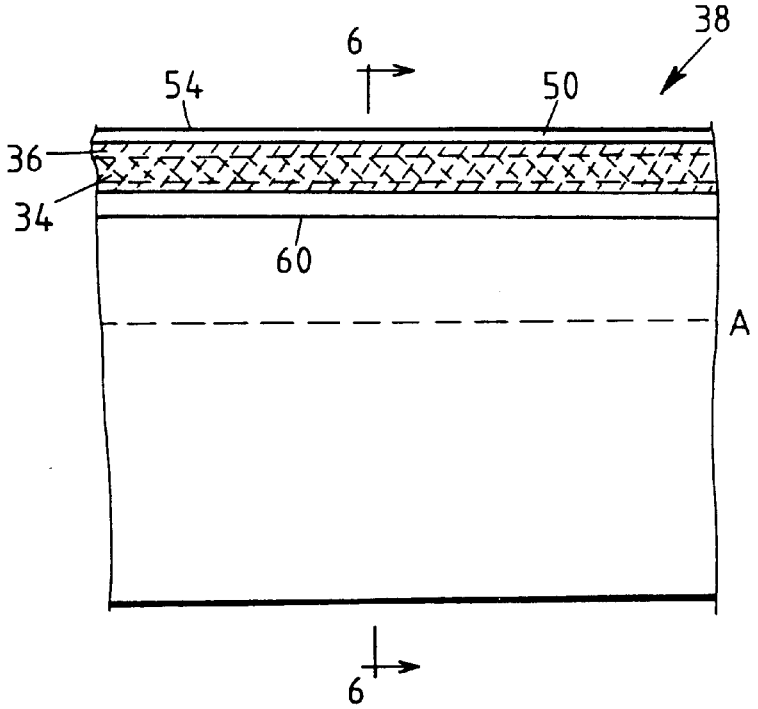
FIG. 4 is a top plan view of the web of material shown in FIG. 3 after folding.
Figure 6:
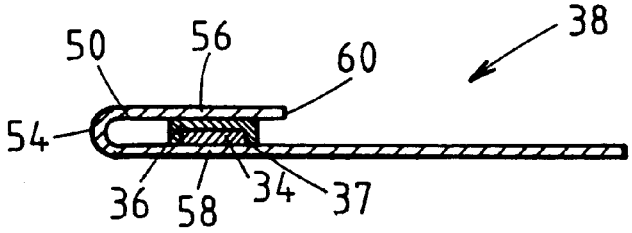
FIG. 6 is a cross-sectional view of FIG. 4 taken generally along line 6—6 of FIG. 4.

A folding station 52 is provided downstream of the adhesive application station 46. As shown in FIG. 4, the folding station 52 produces a fold 54 along the folding zone 50. In so doing, a first layer 56 of the web 38 is formed atop a second layer 58 of the web 38 as shown in FIG. 6. The fold 54 can be formed in any number of manners, including a conventional plow folder using suitable rollers (not shown). As shown in FIGS. 4 and 6, when the first layer 56 is folded over onto the second layer 58, an edge 60 of the web 38 is moved laterally inward, and the fold 54 forms the edge 30 for the page 22. In certain applications it is possible to fold an opposite edge of the web 38 in an identical fashion to thus form two joined pages 22 having bookmarks 32 on both edges.

Figure 5:
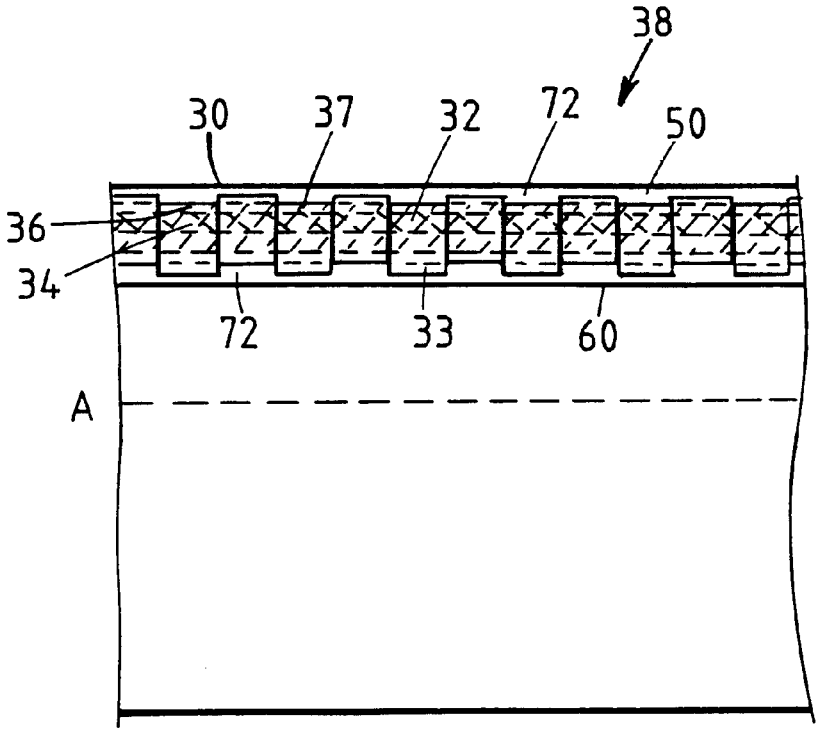
FIG. 5 is top plan view of the web after die-cutting.

Downstream of the folding station 52, a cutting station 62 is provided which cuts the first layer 56 into individual bookmarks 32. The cutting station 62 may be provided in the form of a die-cutter wherein a pair of opposed dies (not shown), one below the moving web 38 and one above the moving web 38, cut through the first layer 56. As shown in FIG. 5, the first layer 56 is preferably cut to form bookmarks 32 extending in alternating opposite directions. Such orientation facilitates repositioning of the bookmarks 32 onto opposed pages 22 of the printed publication 20. More specifically, it will be noted that each of the user-engageable tabs 33 of the bookmarks 32 are provided in alternating directional orientation. The tabs 33 are not in engagement with the adhesive coating 36 and thus are easily grasped by the user.

Once the individual bookmarks 32 are cut by the die-cutting station 62, resulting waste material 72 is removed as shown in FIG. 5. The waste material 72 can be removed by vacuum apparatus, mechanical pickups, or the like, associated with the die-cutting station 62.

As shown in FIG. 2, after the bookmarks 32 are individually die-cut and the waste material 72 is removed, the web 38 may be individually sheared into pages 22 at a shearing station 74. The individual pages 22 are then bound to form the publication 20 at a binding station 76.

Figure 7:
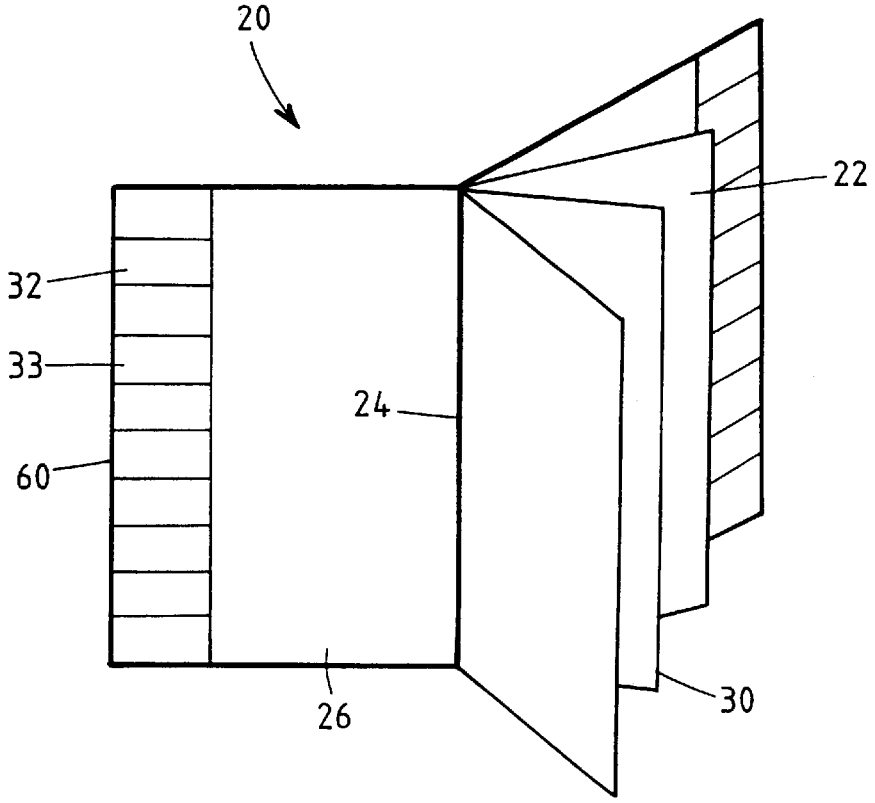
FIG. 7 is an isometric view of an alternative embodiment of the invention.
Figure 8:
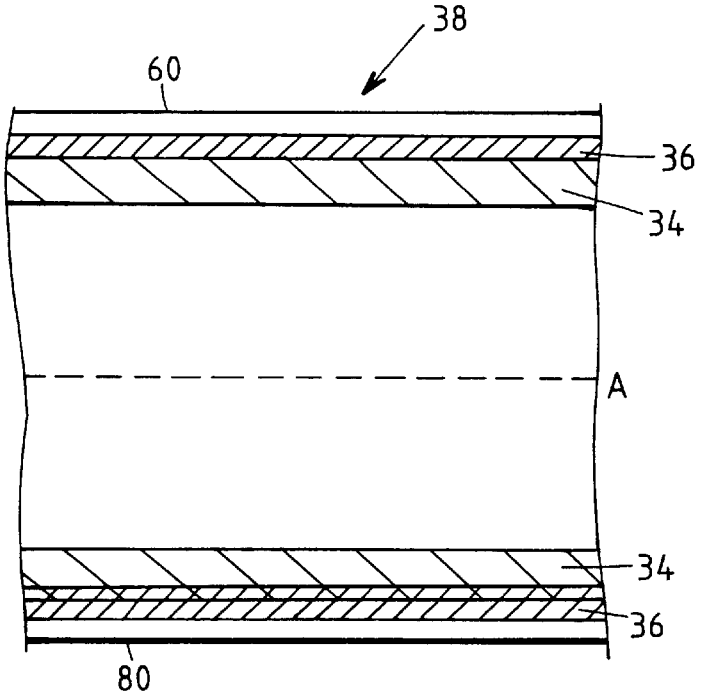
FIG. 8 is a plan view of the web of material used to make the alternative embodiment prior to folding and depicting two approaches to applying the release coating and the adhesive coating.

FIGS. 7 and 8 depict an alternative embodiment of the invention wherein bookmarks 32 are provided immediately adjacent the edge 30 of the page 22. The bookmarks 32 can be formed in a rectangular shape depicted, but, alternatively, can be formed in practically any other shape including, but not limited to, triangles, squares, diamonds, trapezoids, circles, and crescents.

It can be seen from FIG. 8 that the adhesive coating 36 can be positioned in multiple ways including immediately laterally adjacent to the release coating 34 (as shown adjacent the edge 60), or overlapping the release coating 34 (as shown adjacent the edge 80). Upon folding the first layer 56 onto the second layer 58, the web 38 can be trimmed along the fold 54 to separate the bookmarks 32 from the page 22 prior to die-cutting the individual bookmarks 32.

From the foregoing it can therefore be seen that the present invention provides an improved printed publication having integrated labels or bookmarks, as well as a method for manufacturing same.

What is claimed is:

1. A method of manufacturing a printed publication with integrated releasable bookmarks, comprising the steps of:

printing characters onto a moving web of material, the web moving along a longitudinal axis;

applying a strip of release coating to a portion of the moving web in the direction of the longitudinal axis;

applying a strip of adhesive coating to the moving web in the direction of the longitudinal axis;

folding the moving web between the strip of release coating and the strip of adhesive coating to form a first layer atop a second layer connected by a fold, the strip of adhesive coating engaging the strip of release coating;

cutting the first layer into individual bookmarks, each bookmark being adhered by the strip of adhesive coating to the strip of release coating;

cutting the moving web into individual pages; and binding the individual pages together.

2. The method of claim 1 wherein the step of cutting the first layer results in waste material, and the method further includes the step of removing the waste material.

3. The method of claim 1 wherein the printing step and the step of cutting the first layer are performed such that the bookmarks are oriented in alternating directions.

4. The method of claim 1 wherein the strip of adhesive coating engages a portion of the material adjacent the strip of release coating and in addition to the strip of release coating after the folding step.

5. The method of claim 1 wherein the cutting step is performed by die-cutting the first layer into the individual bookmarks.

6. The method of claim 1 further including the step of trimming the moving web proximate the fold along the longitudinal axis.

7. The method of claim 1 wherein the strip of adhesive coating is applied immediately laterally adjacent to the strip of release coating.

8. The method of claim 1 wherein the strip of adhesive coating overlaps the strip of release coating.

9. The method of claim 1 wherein the cutting step forms rectangularly shaped bookmarks.

10. A method of manufacturing printed material having a plurality of bookmarks adhered to the printed material, comprising the steps of:

providing a moving web of printed material;

applying a strip of release coating along a longitudinal axis of the printed material;

applying a strip of adhesive coating substantially parallel to the strip of release coating;

folding the moving web between the strip of release coating and the strip of adhesive coating such that the adhesive coating adheres a first layer of the moving web to a second layer of the moving web, the adhesive being adhered to the release coating and the printed material; and cutting the first layer into individual bookmarks.

11. The method of claim 10 wherein the strip of adhesive coating is wider than the strip of release coating.

12. The method of claim 10 further including the steps of cutting the moving web into individual pages and binding the pages together into a printed publication.

13. The method of claim 10 wherein the cutting step results in bookmarks oriented in alternating directions.

14. The method of claim 10 wherein the moving web is printed and the release coating is applied and cured on a separate production line from a production line which performs the adhesive application, folding, and cutting steps.

15. A method of manufacturing a printed publication with integrated releasable bookmarks, comprising the steps of:

printing characters onto a moving web of material, the web moving along a longitudinal axis;

applying a strip of release coating to a portion of the moving web in the direction of the longitudinal axis;

applying a strip of adhesive coating to the moving web in the direction of the longitudinal axis;

folding the moving web between the strip of release coating and the strip of adhesive coating to form a first layer atop a second layer connected by a fold, the strip of adhesive coating engaging the strip of release coating;

cutting the first layer into individual bookmarks, each bookmark being adhered by the strip of adhesive coating to the strip of release coating;

cutting the moving web into individual pages; and binding the individual pages together.

16. The method of claim 15, wherein the step of cutting the first layer results in waste material, and the method further includes the step of removing the waste material.

17. The method of claim 15, wherein the printing step and the step of cutting the first layer are performed such that the bookmarks are oriented in alternating directions.

18. The method of claim 15, wherein the strip of adhesive coating engages a portion of the material adjacent the strip of release coating and in addition to the strip of release coating after the folding step.

19. The method of claim 15, wherein the cutting step is performed by die-cutting the first layer into the individual bookmarks.

20. The method of claim 15, further including the step of trimming the moving web proximate the fold along the longitudinal axis.

21. The method of claim 15, wherein the strip of adhesive coating is applied immediately laterally adjacent to the strip of release coating.

22. The method of claim 15, wherein the strip of adhesive coating overlaps the strip of release coating.

23. The method of claim 15, wherein the cutting step forms rectangularly shaped bookmarks.

24. A method of manufacturing printed material having a plurality of bookmarks adhered to the printed material, comprising the steps of:

providing a moving web of printed material;

applying a strip of release coating along a longitudinal axis of the printed material;

applying a strip of adhesive coating substantially parallel to the strip of release coating;

folding the moving web between the strip of release coating and the strip of adhesive coating such that the adhesive coating adheres a first layer of the moving web to a second layer of the moving web, the adhesive being adhered to the release coating and the printed material; and cutting the first layer into individual bookmarks.

25. The method of claim 24, wherein the strip of adhesive coating is wider than the strip of release coating.

26. The method of claim 24, further including the steps of cutting the moving web into individual pages and binding the pages together into a printed publication.

27. The method of claim 24, wherein the cutting step results in bookmarks oriented in alternating directions.

28. The method of claim 24, wherein the moving web is printed and the release coating is applied and cured on a separate production line from a production line which performs the adhesive application, folding, and cutting steps.

* * * * *